US008123072B2

(12) United States Patent
Spivey

(10) Patent No.: US 8,123,072 B2
(45) **Date of Patent: *Feb. 28, 2012**

(54) CARTON WITH AN IMPROVED DISPENSING FEATURE

(75) Inventor: Raymond Rudolph Spivey, Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/094,962

(22) Filed: Apr. 27, 2011

(65) Prior Publication Data

US 2011/0198366 A1 Aug. 18, 2011

Related U.S. Application Data

(63) Continuation of application No. 12/406,537, filed on Mar. 18, 2009, now Pat. No. 7,946,451, which is a continuation of application No. 11/470,428, filed on Sep. 6, 2006, now Pat. No. 7,523,842, which is a continuation of application No. 10/959,870, filed on Oct. 6, 2004, now Pat. No. 7,175,047, which is a continuation of application No. 10/777,614, filed on Feb. 12, 2004, now Pat. No. 7,100,798, which is a continuation of application No. 10/425,846, filed on Apr. 29, 2003, now Pat. No. 6,715,639, which is a continuation of application No. 09/757,714, filed on Jan. 9, 2001, now Pat. No. 6,578,736.

(51) Int. Cl.
*A47F 1/04* (2006.01)

(52) U.S. Cl. ..... 221/305

(58) Field of Classification Search ..... 221/305
See application file for complete search history.

(56) References Cited

U.S. PATENT DOCUMENTS

| | | | |
|---|---|---|---|
| 902,347 | A | 10/1908 | Tillinghast |
| 1,541,143 | A | 6/1925 | Hoile |
| 1,925,102 | A | 9/1933 | Levkoff |
| 2,124,808 | A | 7/1938 | White et al. |
| 2,284,965 | A | 9/1942 | Davidson |
| 2,294,964 | A | 9/1942 | Davidson |
| 2,448,819 | A | 9/1948 | Mitchell |

(Continued)

FOREIGN PATENT DOCUMENTS

CA 874828 7/1971

(Continued)

OTHER PUBLICATIONS

"Dispensing Multipack, Coke Canner Rolls Out 'Fridge-Friendly' Pack," Packaging World, Sep. 2001, p. 2, [Summit Publishing Company—Chicago].

(Continued)

*Primary Examiner* — Timothy Waggoner
(74) *Attorney, Agent, or Firm* — Womble Carlyle Sandridge & Rice, LLP

(57) ABSTRACT

A carton with an improved dispenser at one of the carton which preserves the integrity of the carton when the carton is opened by permitting a bottom end flap attached to the bottom panel to remain in place and also a portion of each side end flap that is adjacent to the bottom end flap. This dispenser may also provide a safety net for the first container that is automatically dispensed when the carton is opened.

21 Claims, 4 Drawing Sheets

U.S. PATENT DOCUMENTS 2,718,301 A 9/1955 Palmer
2,723,027 A 11/1955 Guyer
2,754,047 A 7/1956 Schmidt et al.
2,842,304 A 7/1958 Ringler
2,868,431 A 1/1959 Painter
2,919,844 A 1/1960 Anderson, Jr.
2,930,516 A 3/1960 Fowle et al.
2,975,891 A 3/1961 Stone
2,990,097 A 6/1961 Thompson
3,002,651 A 10/1961 Gauld
3,018,031 A 1/1962 Ahlbor et al.
3,178,242 A * 4/1965 Ellis et al. ..... 221/67
3,228,582 A 1/1966 Osberg
3,263,861 A 8/1966 Carr
3,265,283 A 8/1966 Farquhar
RE26,083 E 9/1966 Forrer
3,300,115 A 1/1967 Schauer
3,332,594 A 7/1967 De Capua
3,356,279 A 12/1967 Root
3,517,858 A 6/1970 Farquhar
3,540,581 A 11/1970 Koolnis
3,599,858 A 8/1971 Samsing
3,669,251 A 6/1972 Phillips, Jr.
3,765,527 A 10/1973 Vargo
3,894,681 A 7/1975 Arneson et al.
3,913,739 A 10/1975 Hennessey
3,933,303 A 1/1976 Kirby
3,942,631 A 3/1976 Sutherland et al.
4,000,811 A 1/1977 Hardison et al.
D243,508 S 3/1977 Killy
4,030,596 A 6/1977 Snyder et al.
D252,259 S 7/1979 Rinehart
4,214,660 A 7/1980 Hunt, Jr.
4,216,861 A 8/1980 Oliff
4,222,485 A 9/1980 Focke
D263,204 S 3/1982 Dutcher
4,325,482 A 4/1982 Feeser
4,331,289 A 5/1982 Killy
4,364,509 A 12/1982 Holley, Jr. et al.
4,375,258 A 3/1983 Crayne et al.
D269,068 S 5/1983 Mann, Sr. et al.
D270,041 S 8/1983 Vestal
4,396,143 A 8/1983 Killy
4,416,410 A 11/1983 Herrmann
4,417,661 A 11/1983 Roccaforte
4,465,180 A 8/1984 Klygis
4,498,581 A 2/1985 Dutcher
4,519,522 A 5/1985 McElwee
4,582,199 A 4/1986 Schuster
4,598,810 A 7/1986 Shore et al.
D286,987 S 12/1986 Golan et al.
4,726,471 A 2/1988 Whately et al.
4,756,419 A 7/1988 Le Bras
4,785,991 A 11/1988 Schuster
4,817,866 A 4/1989 Wonnacott
D303,090 S 8/1989 Armor et al.
4,860,944 A 8/1989 Wonnacott
4,919,266 A 4/1990 McIntosh, Jr. et al.
4,961,507 A 10/1990 Higgins
4,966,324 A 10/1990 Steel
4,972,991 A 11/1990 Schuster
4,974,771 A 12/1990 Lavery
4,981,253 A 1/1991 Quaintance
5,002,186 A 3/1991 Cooper
5,031,825 A 7/1991 Romagnoli
5,067,615 A 11/1991 Davitian
5,101,642 A 4/1992 Alexandrov
5,123,589 A 6/1992 Cote
5,137,211 A 8/1992 Summer et al.
5,170,934 A 12/1992 Lemoine
D332,915 S 2/1993 Hoell et al.
5,205,436 A 4/1993 Savage
5,277,360 A 1/1994 DeMott
5,279,440 A 1/1994 Fougeres et al.
5,284,292 A 2/1994 Johnson
5,333,734 A 8/1994 Stout et al.
5,337,920 A 8/1994 Clausen
5,368,194 A 11/1994 Oliff et al.
5,402,933 A * 4/1995 Behrmann ..... 229/231
5,427,242 A 6/1995 Oliff et al.
5,465,831 A 11/1995 Smith
5,505,372 A 4/1996 Edson et al.
5,518,111 A 5/1996 Stout
5,622,309 A 4/1997 Matsuda et al.
5,722,584 A 3/1998 Fujiwara
5,775,574 A 7/1998 Whitnell
5,788,117 A 8/1998 Zimmanck
5,826,783 A 10/1998 Stout
5,833,118 A 11/1998 Weiss
5,873,515 A 2/1999 Dunn et al.
5,878,947 A 3/1999 Hoy et al.
5,881,884 A 3/1999 Podosek
6,105,854 A 8/2000 Spivey et al.
D436,859 S 1/2001 Botsford et al.
6,176,419 B1 1/2001 Holley, Jr.
6,283,293 B1 9/2001 Lingamfelter
D454,784 S 3/2002 Oram
6,386,369 B2 5/2002 Yuhas et al.
6,435,351 B1 8/2002 Gibb
6,478,219 B1 11/2002 Holley, Jr.
6,484,903 B2 11/2002 Spivey et al.
6,550,615 B2 4/2003 Lingamfelter
6,578,736 B2 6/2003 Spivey
6,631,803 B2 10/2003 Rhodes et al.
6,715,639 B2 4/2004 Spivey
6,866,185 B2 3/2005 Harrelson
7,059,494 B2 6/2006 Harrelson et al.
7,100,798 B2 9/2006 Spivey
7,175,047 B2 2/2007 Spivey
7,523,842 B2 4/2009 Spivey
7,946,451 B2 * 5/2011 Spivey ..... 221/305
2002/0070139 A1 6/2002 Bates
2002/0185499 A1 12/2002 Harrelson et al.
2002/0185527 A1 12/2002 Bates
2003/0141353 A1 7/2003 Wilson
2003/0192907 A1 10/2003 Bates
2004/0060972 A1 4/2004 Harrelson

FOREIGN PATENT DOCUMENTS

CA 2246020 2/2000
DE 2323589 11/1974
DE 75 10 538 8/1975
DE 76 06 493 U1 6/1976
DE 29 33 022 C2 2/1980
DE 81 35 176 U1 5/1982
DE 8514718.4 8/1985
DE 8629664.7 11/1986
DE 3612594 A1 10/1987
DE 30 07 769 C2 9/1991
DE 40 23 043 A1 12/1991
DE 94 12 885 U1 10/1994
DE 94 13 813 U1 10/1994
DE 295 19 931 U1 2/1996
DE 296 02 010 U1 3/1996
DE 299 09 008 U1 9/1999
DE 29913585 U1 10/1999
DE 694 21 620 T2 4/2000
EP 235 852 B1 9/1987
EP 0 323 596 A1 7/1989
EP 0 342 088 A1 11/1989
EP 0475147 A1 3/1992
EP 0 659 143 6/1995
EP 0 752 370 A2 1/1997
EP 0849189 A1 6/1998
EP 0 936 995 8/1999
EP 1 060 998 A2 12/2000
FR 2 683 207 5/1993
GB 2 186 550 8/1987
JP 7-9721 7/1993
WO WO-88/09750 12/1988
WO WO-95/25668 9/1995
WO WO-96/29260 A1 9/1996
WO WO-97/21607 6/1997
WO WO-9831593 A1 7/1998
WO WO-99/64301 A1 12/1999
WO WO-00/23334 4/2000
WO WO-00/71428 A1 11/2000

| | | | |
|---|---|---|---|
| WO | WO-01/28871 | A1 | 4/2001 |
| WO | WO-02/04302 | A1 | 1/2002 |
| WO | WO-02/085739 | A1 | 10/2002 |

OTHER PUBLICATIONS

"Hot Hit With Consumers," International Bottler & Packer, Nov. 2001 [Binstead Publications Ltd.].

"Coke Bottler Tests a Slimmer Soda Package", Wall Street Journal B3 (Aug. 10, 2001).

"Passing the Torch", Beverage World p. 36 (Oct. 2002).

"Riverwood" For the Carton Designated as 'Fridge Pack,' International Bottler & Packer, Nov. 2001 [Binstead Publications Limited—United Kingdom].

"Coca-Cola Fridge Mate", p. 3 Revise Woolworth's Advertisement wca4000 / N1A.

"*Riverwood International Corporation* v. *MeadWestvaco Corporation*" Civ. Action No. 1:03CV1672 (Jun. 17, 2003 N.D. Ga.) Plaintiff's [Riverwood] Motion for Prelim. Injunction.

"*Riverwood International Corporation* v. *MeadWestvaco Corporation*" Civ. Action No. 1:03CV1672 (N.D. Ga.) Defendant's [MeadWestvaco] Memorandum in Opposition to Plaintiff's [Riverwood] Motion for a Preliminary Injunction.

"*Riverwood International Corporation* v. *MeadWestvaco Corporation*" Civ. Action No. 1:03CV1672 (N.D. Ga.) Plaintiffs [Riverwood] Reply to Defendant's [MeadWestvaco] Memorandum in Opposition to Plaintiffs [Riverwood] Motion for a Preliminary Injunction.

"*Riverwood International Corporation* v. *Meadwestvaco Corporation*," Civ. Action No. 1:03-CV1672 (TWT) (N.D. Ga.), Riverwood's Supplemental Pre-Hearing Brief in Support of Plaintiff's [Riverwood] Motion for Preliminary Injunction.

"*Riverwood International Corporation* v. *Meadwestvaco Corporation*," Civ. Action No. 1:03-CV1672 (TWT) (N.D. Ga.), Meadwestvaco's Supplemental Memorandum in Opposition to Riverwood's Motion for a Preliminary Injunction.

* cited by examiner

CARTON WITH AN IMPROVED DISPENSING FEATURE

CROSS-REFERENCE TO RELATED APPLICATION

This application is a continuation of U.S. patent application Ser. No. 12/406,537, filed Mar. 18, 2009 now U.S. Pat. No. 7,946,451, which is a continuation of U.S. patent application Ser. No. 11/470,428, filed Sep. 6, 2006, now U.S. Pat. No. 7,523,842, which is a continuation of U.S. patent application Ser. No. 10/959,870, filed Oct. 6, 2004, now U.S. Pat. No. 7,175,047, which is a continuation of U.S. patent application Ser. No. 10/777,614, filed Feb. 12, 2004, now U.S. Pat. No. 7,100,798, which is a continuation of U.S. patent application Ser. No. 10/425,846, filed Apr. 29, 2003, now U.S. Pat. No. 6,715,639, which is a continuation of U.S. patent application Ser. No. 09/757,714, filed Jan. 9, 2001, now U.S. Pat. No. 6,578,736, which are incorporated herein by reference in their entirety.

BACKGROUND OF THE INVENTION

1. Field of the Invention

The present invention relates generally to an enclosed paperboard carton capable of enclosing containers, which carton has a unique opening and dispensing feature that allows the containers, for example, cans or bottles, to be removed or dispensed without destroying the overall structural integrity of the carton. The dispensing feature may also provide a safety net for the first container that is automatically dispensed when the carton is opened. This dispensing feature also permits the carton to be carried from one location to another after the dispenser has been opened without the containers falling out of the carton.

2. Background

Fully enclosed carton capable of enclosing cans have been used in the past that have a feature for dispensing the cans one at a time. Dispenser sections have been provided at various locations within these cartons depending on the design. Many of these dispensers suffer from the disadvantage that once open, they allow all of the containers to roll out. In addition, it is difficult to carry one of these cartons without the containers falling out once the dispenser has been opened. Most of these dispensers have been designed for dispensing cans or bottles which have cylindrical tops and bottoms of substantially the same size and configuration. These dispensers are not suitable for dispensing bottles that have a neck of smaller diameter than the body of the bottle.

In effect, many of these dispensers destroy the overall carton integrity once they have been opened. Many of these dispensing features do not have any means for preventing the first container that is automatically dispensed from falling free from the carton. In other words, its dispensing feature has no safety net.

3. Prior Art

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the side walls to permit grasping of the can to withdraw it from the carton. When the flap is opened, the cans are held in the carton by an accurate flap portion extending downwardly in the end wall into the center of the aperture. The structural integrity of this carton is compromised because the entire bottom end of the carton is opened. The dispensing flap does not provide a safety net to prevent a can from rolling out of the carton and falling to the floor. This carton cannot be easily moved from one location to another after the dispenser has been opened without the containers falling out. It will be realized that the design of this carton is not satisfactory for dispensing bottles with necks as the exiting container being dispensed needs to have a corresponding cylindrical top and bottom of approximately the same size to facilitate easy dispensing by a person grasping the ends of the exiting container.

U.S. Pat. No. 4,364,509 to Holley, Jr. et al. also discloses a fully enclosed carton with a dispenser in one of the end walls. This dispenser is likewise formed in the end wall by tearing out an end flap and lowering it into proper position. Expansion slits are provided in the side wall for the user's fingers to grasp the ends of the exiting can. This carton is not adapted for use with bottles, because of the necessity of grasping the ends of the container for removal. In addition, it is not adapted for carrying cans once the carton has been opened as they are likely to roll out of the dispenser. There is also no safety net to receive the cans as they are rolled out of the dispenser.

SUMMARY OF THE INVENTION

It is an object of this invention to provide a dispenser that preserves the integrity of the carton after the dispenser has been opened. It is a further object to provide a dispenser that can be used with both cans and bottles. It is another object of this invention to provide a safety net or basket for the containers that are automatically dispensed when the dispenser is opened. It is a still further object of this invention is to develop a dispenser that will permit the carton to be moved from one location to another after it has been opened without discharging containers. The final object of this invention is to provide a dispenser that can be easily opened.

Briefly described, in a preferred form, the objects of this invention are achieved by providing an enclosed carton that has a unique dispenser in the exiting end of the carton. This carton is generally rectangular and has a bottom, a top, two sides, a closed end and an exiting end. The carton is foldably constructed from a blank having panels and flaps. The exiting end or ends of the carton permits containers to be taken from the carton via the dispenser.

This carton has a dispenser that is torn from an end of the carton by tearing an end portion of the top panel, a triangular portion from the adjoining side panels, and all of the side end flaps except the bottom most portions, to form a dispenser. The top end flap is removed when this dispenser is opened. This dispenser may have a semi-circular score line attached to the dispenser score line in the top panel for easy opening of the dispenser. A person's fingers can be inserted between this semi-circular score line and the dispenser to commence the opening of the dispenser. This semi-circular score line is placed so that when it is pushed open, a person's fingers will go between the first and second containers inside of the carton. A score line can be provided that bisects the semi-circular score line parallel to the longitudinal axis of the containers to permit ease of entry of a person's fingers. The bottom portions of the side end flaps are left intact to preserve the structural integrity of the carton and also to provide a wall to prevent an end container in the bottom of the carton from accidentally rolling out.

It should be realized that the dispenser does not have to be totally removed from the carton, as the score lines in the side and top panels can be broken and the dispenser flipped over along the score lines in the side end flaps to form a safety net or basket when the first container in the top of the carton rolls out of the dispenser. If the score line in the side end flaps is not broken, the dispenser can be reclosed.

This carton can be constructed by gluing, taping, stapling and the like, or by locking. The dispenser of this invention can be put in one end of the carton or in both ends. A dispenser can be torn from the carton and placed under the other end of the carton to elevate it to facilitate the removal of the containers from the carton. These and other objects, features, and advantages of the present invention will become more apparent upon reading the following specification in conjunction with the accompanying drawing figures.

DETAILED DESCRIPTION OF THE PREFERRED EMBODIMENTS

Figure 1:
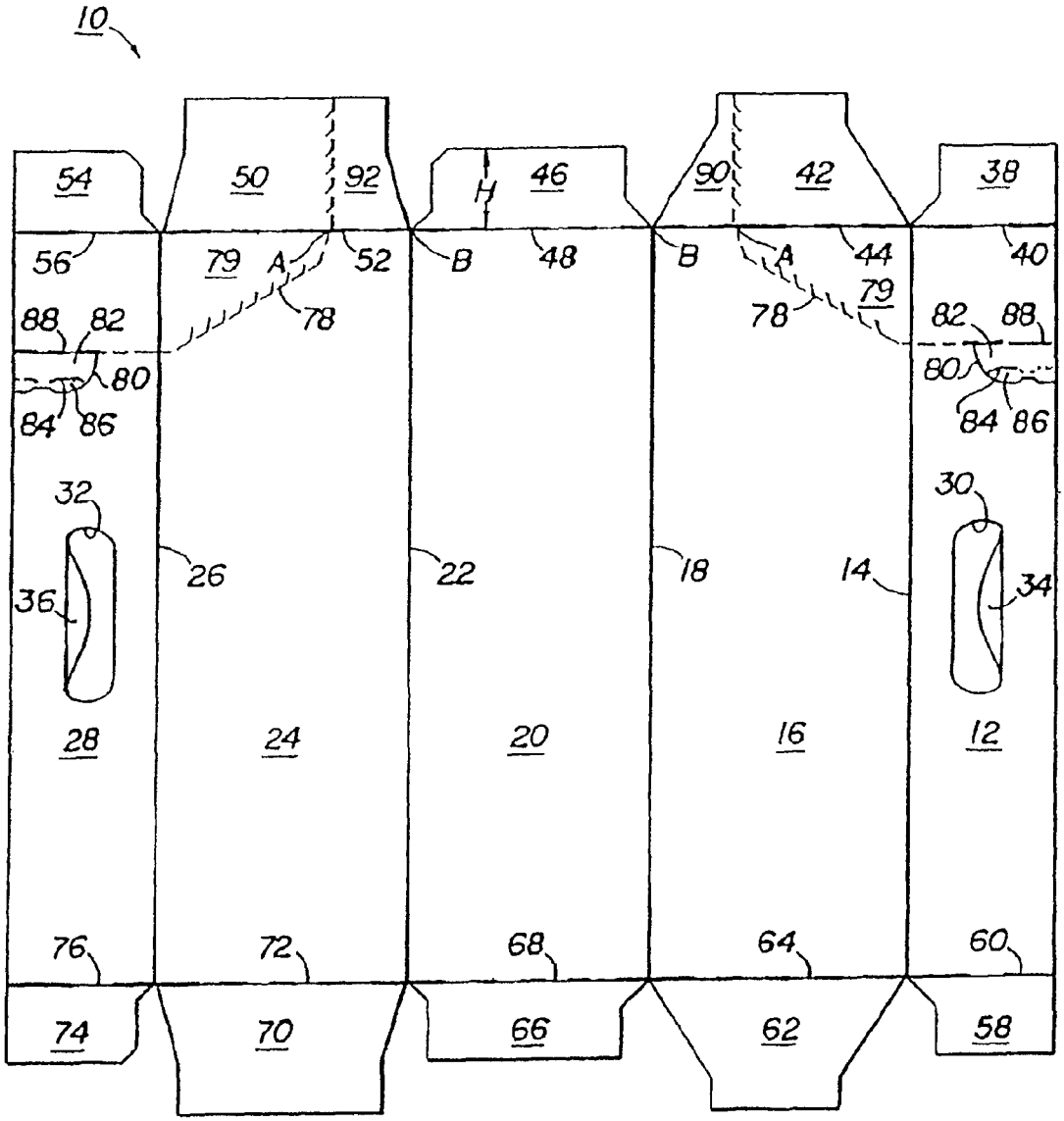
FIG. 1 is a plan view of a blank from which a carton according to this invention is formed.

The present invention is intended primarily for use with cans and bottles of the types used to contain soft drinks, beer and the like. The blank 10 is formed from a foldable sheet material, such as paperboard. The blank has a top flap 12 which is connected by fold line 14 to side panel 16, which in turn is connected by fold line 18 to bottom panel 20. Bottom panel 20 is connected by fold line 22 to side panel 24, which in turn is connected by fold line 26 to top flap 28.

This carton is capable of containing cans or bottles in two rows of six containers each. This carton has the "racetrack" handle 30 and 32 formed in the top flaps, 12 and 28, respectively. Cushioning flaps 34 and 36 are provided for the comfort of a person's hands, and are foldably joined to top flaps 12 and 28. On the exiting-end of the carton, top end flap 38 is joined to top flap 12 by fold line 40. Side end flap 42 is joined to side panel 16 by fold line 44. Bottom end flap 46 is joined to bottom panel 20 by fold line 48. Side end flap 50 is joined by fold line 52 to side panel 24. Top end flap 54 is joined to top flap 28 by fold line 56.

On the closed end of the carton, top end flap 58 is connected to top flap 12 by fold line 60, side end flap 62 is connected to side panel 16 by fold line 64, bottom end flap 66 is attached to bottom panel 20 by fold line 68, side end flap 70 is connected to side panel 24 by fold line 72 and top end flap 74 is connected to top flap 28 by fold line 76.

It will be understood by those skilled in the art that the carton of the present invention is generally symmetrical about a horizontal line of bisection, as viewed when FIG. 1 is rotated lengthwise. This symmetry aids in the efficient production of the present carton.

In forming this blank 10 into a carton, top flap 12 is glued to top flap 28 forming a sleeve. The cans or bottles are then loaded into the carton on their sides and the various end flaps on both ends are closed. Using one end as an example, top end flaps 38 and 54 are folded downwardly and bottom end flap 46 is folded upwardly and then side end flaps 42 and 50 are folded sideways. These various end flaps are held together by glue or other means. The other end of the carton is glued and closed in the same fashion.

When the blank is folded and glued, the resulting carton has a closed end and an exiting end. However, a dispenser can be placed on both ends of the cartons. The containers exit the carton through the exiting end of the carton. The exiting end of the carton has a tear line 78 that extends through the top flaps 12 and 28, through the side panels 16 and 24 to form a triangular dispensing flap on the dispenser 79 into the side end flaps 42 and 50. In order to facilitate the opening of this dispenser 79, a finger flap 82 may be provided for the easy insertion of the fingers to start the tearing of the dispenser 79. Finger flap 82 is connected to top flaps 12 and 28 by tear line 80. Finger flap 82 may be provided with insertion flap 86 to facilitate entry of the fingers into the carton. For the opening of the dispenser 79, insertion flap 86 is connected to finger flap 82 by fold line 84. Finger flap 82 and insertion flap 86 are connected to the dispenser 79 by fold line 88 which interrupts the tear line 78. It will be noticed that tear line 78 extends into side end flaps 42 and 50 so as to form a substantial bottom portion 90 and 92 so that the end of the carton will have a bottom end when the dispenser 79 is opened.

Figure 2:
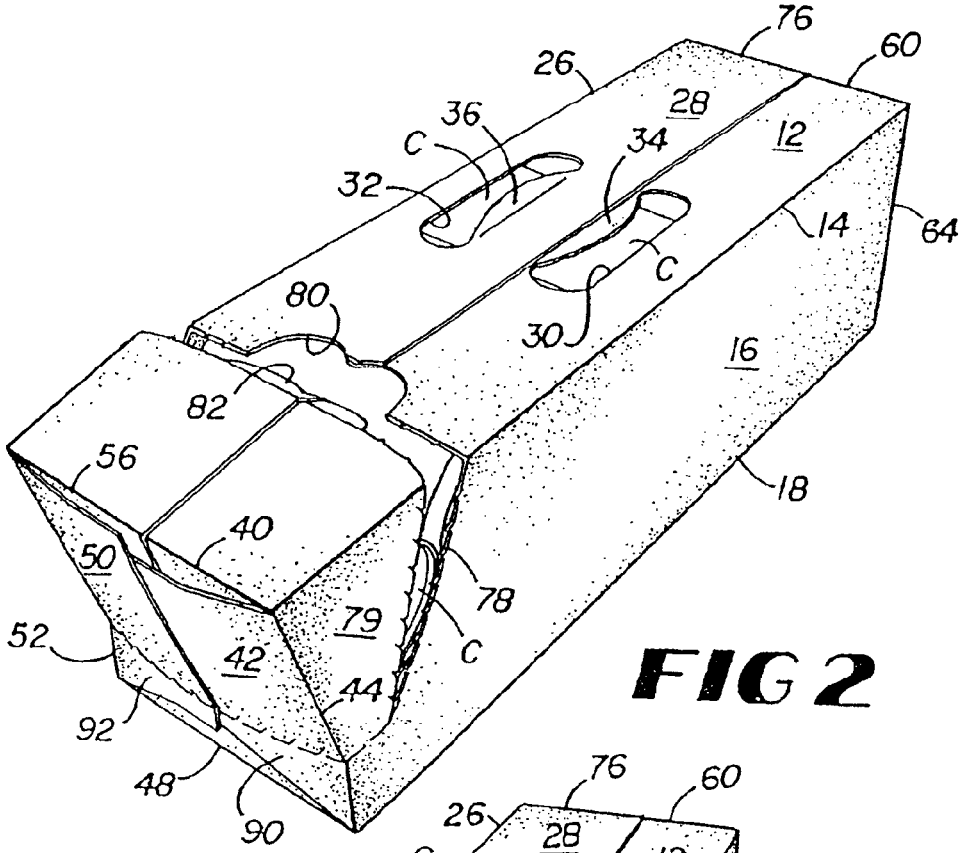
FIG. 2 is a perspective end view of the carton loaded with cans showing the dispenser being partially opened.

FIG. 2 shows the carton full of cans with the dispenser 79 open except for the tear lines 78 through the side end flaps 42, 50. It will be noted that the dispenser is a unitary structure. The dispenser 79 is opened by a person inserting his or her fingers into finger flap 82 and pulling the dispenser 79 open. Insertion flap 86 is provided to facilitate the entry of the fingers into the opening provided by finger flap 82. Finger flap 82 and insertion flap 86 are placed so that the fingers will enter the interior of the carton between the first and second cans.

Figure 3:
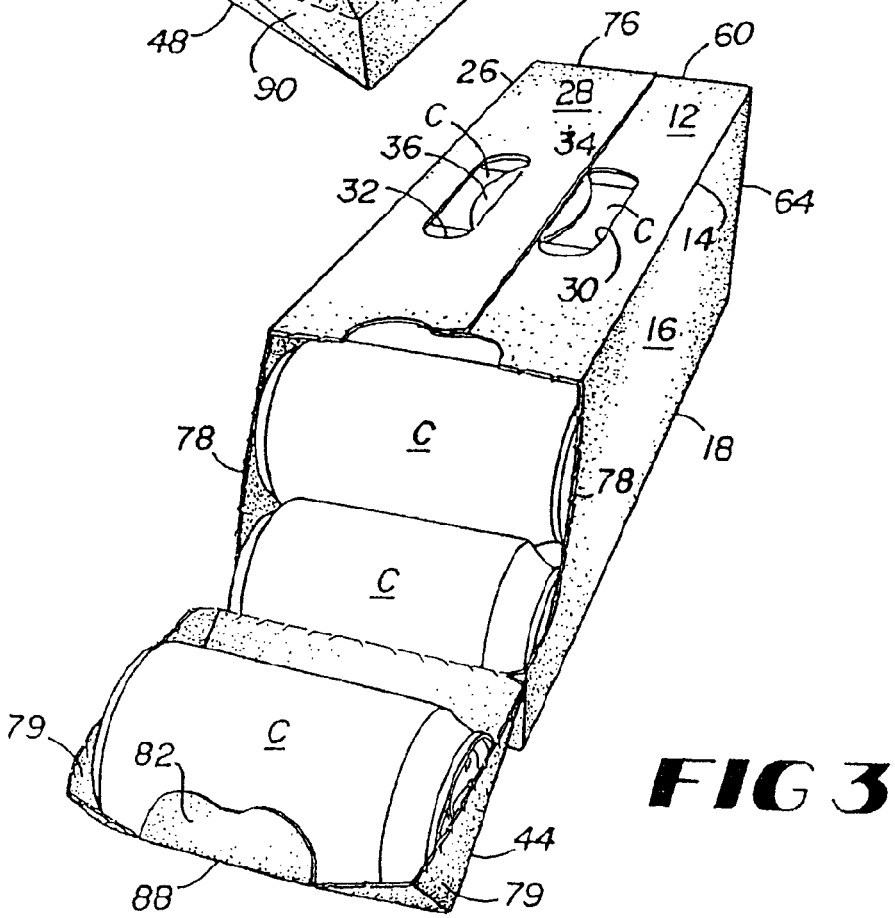
FIG. 3 is a perspective end view of the carton containing cans with the basket shaped dispenser open but attached and containing a can.

FIG. 3 shows the dispenser 79 completely opened but still attached to the carton by tear line 78 not being torn open through side end flaps 42 and 50. When the dispenser 79 is completely opened, the top can C will fall into the basket formed by the dispensing flap 79 and be retained. This dispenser 79 serves as a safety net to prevent the can from leaving the vicinity of the carton. The dispenser 79 forms a basket with triangular flaps forming side walls, side end flaps 42 and 50 forming a bottom wall and the torn off portions of the top flaps 12 and 28 forming an end wall.

Figure 4:
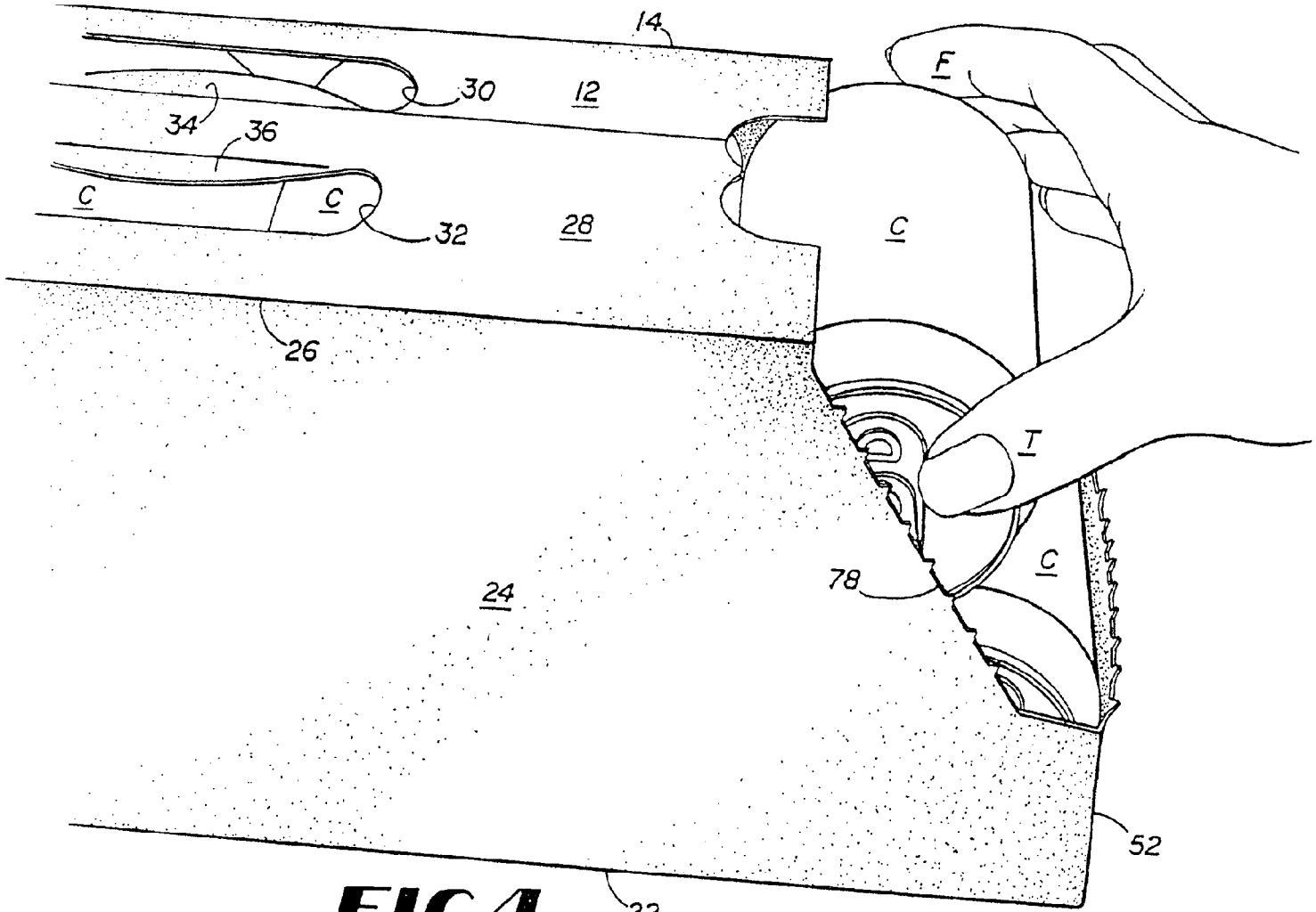
FIG. 4 is a perspective side view of the carton containing cans showing the top most end can being gripped by hand for removal from the carton.

In order to maintain the structural integrity of this carton, the bottom portions 90 and 92 of the side end flaps 42 and 50 are not removed from the carton when the dispenser is removed. The structural integrity of the carton is improved by the fact that the bottom end flap 46 is not removed. The bottom end flap 46 has a height H approximately equal to the distance between A and B along fold lines 44 and 52 respectively. This means that the bottom end flap 46 has the same height as the bottom portions 90 and 92 of the side end flaps 42 and 50, thus producing a strong bottom end structure. As shown in FIGS. 3 and 4, the height of the bottom end structure formed by 46, 90, and 92 is less than the diameter of a can C.

If desired, the dispenser 79 can be totally removed from carton or left attached along tear line 78 in side flaps 42 and 50 and reclosed.

As illustrated in FIG. 4, a can C can be easily removed from the carton by using the fingers F and the thumb T of a hand.

Figure 5:
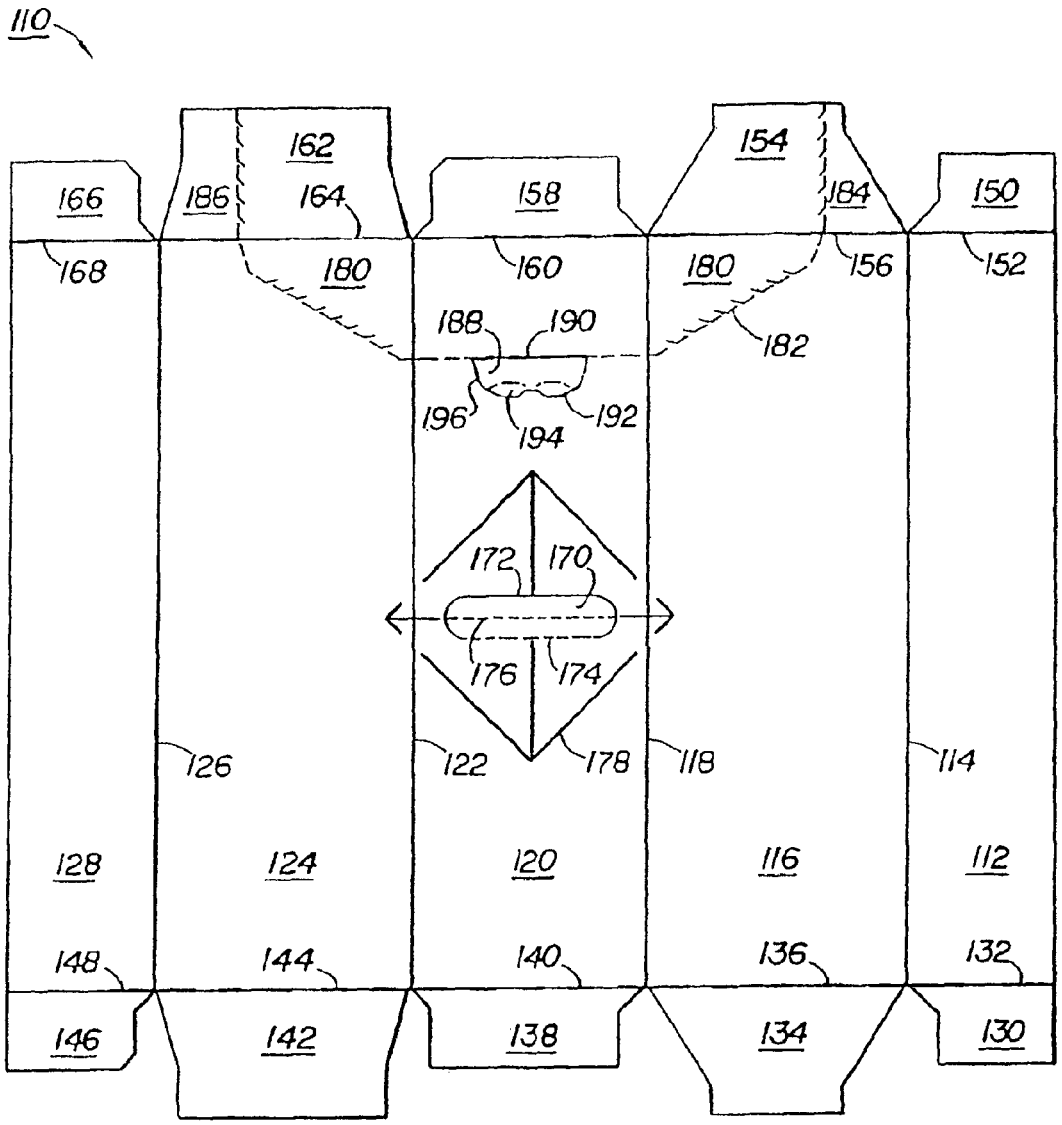
FIG. 5 is a plan view of the blank from which a carton according to this invention is formed having a single handle opening with the bottoms flaps being designed to be glued together.

FIG. 5 is a plan view of a blank from which a carton containing cans in three rows of four cans each according to the invention is formed. This carton has a single slot handle for carrying. The blank 110 has a bottom flap 112 which is connected by fold line 114 to side panel 116, which in turn is connected by fold line 118 to top panel 120. Top panel 120 in turn is connected by fold line 122 to side panel 124 which in turn is connected by fold line 126 to bottom flap 128. On the closed end of the carton, bottom end flap 130 is foldably connected by fold line 132 to bottom flap 112. Side end flap 134 is connected by fold line 136 to side panel 116. Top end flap 138 is connected by fold line 140 to top panel 120. Side end flap 142 is connected by fold line 144 to side panel 124 and bottom end flap 146 is connected by fold line 148 to bottom flap 128. The exiting end of the carton has a bottom end flap 150 which is connected to bottom flap 112 by fold line 152. Side end flap 154 is connected by fold line 156 to side panel 116. Top end flap 158 is connected by fold line 160 to top panel 120. Side end flap 162 is connected by fold line 164 to side panel 124. Bottom end flap 166 is connected by fold line 168 to bottom flap 128.

This carton has a slot handle 170 formed by cut line 172 and fold lines 174 and 176. It also has a score line 178 to assist in dissipating the forces involved in lifting a loaded carton.

A dispenser 180 is formed by tearing tear line 182 which extends from the top panel 120 through side panels 116, 124 and into side end flaps 154 and 162. Tear line 182 extends into side end flaps 154 and 162, so as to leave bottom portions 184, 186 that has a height when the carton is formed along lines 156, 164 respectively that is approximately equal to the height of bottom end flaps 150 and 166 in order to provide structural strength to the carton. This carton may have a finger flap 188 connected to dispenser 180 by fold line 190 and insertion flap 192 connected to finger flap 188 by fold line 194. Finger flap 188 and insertion flap 192 are joined to top panel 120 by tear line 196.

A sleeve from this carton is prepared by gluing the bottom flap 112 and 128 in an overlapping relationship. This carton is then loaded in the same manner as the carton shown in FIG. 2 through as the end of the cartons. Side end flaps 134, 142, 154, and 162 are glued over the bottom end flaps 130, 146, 150, 166 and top end flaps 138 and 158 to close the ends of the carton. The dispenser is opened in the same manner as the dispenser shown in FIGS. 1 and 2.

The dispenser of this invention can be used for both cans and other types of cylindrical containers. It is particularly useful for PET bottles having a stubby configuration.

Unique Features of the Dispenser of this Invention

One of the unique features of the dispenser of this invention is that it provides easy access to the cans or bottles in the carton but yet does not greatly diminish the structural integrity of the carton. This is partly because the bottom end of the end panel in which the dispenser is located is retained. This accomplished by leaving a bottom portion on the side end panel that is equal in height to the bottom end flaps.

The dispenser of this invention provides an easy opening feature in that it has a finger flap and insertion flap so that a person's fingers can be inserted between the first and second can to open the dispenser.

This dispenser also provides a safety net or basket in that if the tear line for the dispenser is not torn along the side end flaps, it remains attached to the carton and can catch in its basket a can as it is removed from the carton.

While the invention has been disclosed in its preferred forms, it will be apparent to those skilled in the art that many modifications, additions, and deletions can be made therein without departing from the spirit and scope of the invention and its equivalents as set forth in the following claims.

I claim:

1. A method of dispensing a first cylindrical container from a package, the package including an enclosed carton and a plurality of containers disposed in only a first row and a second row; the carton comprising a top, a bottom, a first side, a second side, an exiting end, and a closed end; the exiting end including a first side end flap connected to the first side and a second side end flap connected to the second side; the first side end flap contacting the second side end flap when folded to at least partially form the exiting end; the first container positioned in the first row above a second container in the second row; the first container contacting the top and the exiting end; a third container in the first row adjacent the first container; the carton including a dispenser defined at least partially by a tear line that includes a first tear line portion that extends across the first side end flap to the contact with the second side end flap and a second tear line portion that extends across the second side end flap to the contact with the first side end flap; the method comprising:

separating along the tear line in the top, the first side, and the second side to the first tear line portion and the second tear line portion; and pivoting the dispenser about the first tear line portion and the second tear line portion, wherein the first container is caught in the dispenser when the dispenser is opened.

2. The method of claim 1 wherein, after dispensing the first container, the dispenser can be pivoted toward the top about the first tear line portion and the second tear line portion to reclose the dispenser.

3. The method of claim 1 wherein the dispenser can be separated from the carton along the first tear line portion and the second tear line portion.

4. The method of claim 1 wherein the second container has a diameter and wherein the first tear line portion and the second tear line portion are located a height from the bottom that is less than the diameter.

5. The method of claim 4 wherein the second container is in contact with the bottom and the exiting end.

6. The method of claim 1 wherein the enclosed carton is not adhesively attached to another enclosed carton.

7. The method of claim 1 wherein the top and bottom are substantially parallel, wherein the first side and the second side are substantially parallel, and wherein the exiting end and the closed end are substantially perpendicular the top, the bottom, the first side, and the second side.

8. The method of claim 1 wherein the dispenser defines a unitary structure that includes part of the top, part of the first side, part of the second side, and part of the exiting end.

9. The method of claim 1 wherein a finger flap is formed in the top to facilitate separation of the tear line.

10. The method of claim 9 wherein an insertion flap is connected to the finger flap along a finger flap fold line.

11. The method of claim 9 wherein the finger flap is located between the first container and the third container.

12. The method of claim 9 wherein the tear line in the top is located between the first container and the third container.

13. The method of claim 1 wherein the containers are cans or bottles.

14. The method of claim 1 further including an adhesive capable of holding said first side end flap and said second side end flap together.

15. A package comprising:

a carton enclosing a plurality of containers;

the plurality of containers positioned in only two rows including a first row above a second row; the plurality of containers including a first container in the first row, a second container in the second row, and a third container in the first row adjacent the first container; the first container and the second container contacting an exiting end of the carton;

the carton comprising a top, a bottom, a first side, a second side, the exiting end, and a closed end; the exiting end including a first side end flap connected to the first side and a second side end flap connected to the second side; the first side end flap contacting the second side end flap; the carton including a dispenser being defined at least partially by a tear line that includes a first tear line portion that extends across the first side end flap to the contact with the second side end flap and a second tear line portion that extends across the second side end flap to the contact with the first side end flap; and, wherein the dispenser is separable along the tear line in the top, the first side, and the second side, and wherein the dispenser can be pivoted away from the top about the first tear line portion and the second tear line portion, and wherein the dispenser is configured to catch the first container when the dispenser is opened.

16. The package of claim 15 wherein the first side end flap overlaps the second side end flap.

17. A blank dimensioned to form a carton sized to contain a plurality of containers in only two rows including a first row above a second row, the plurality of containers including a first container in the first row and a second container in the second row; the first container and the second container each contacting an exiting end of the carton, the blank comprising:

a sheet of material having first, second, third, and fourth parallel fold lines therein, said parallel fold lines defining panels of the carton, at a first end of the sheet of material, a transverse fold line connecting end flaps to the panels; each of the end flaps having a free end;

the blank being capable of being formed into the carton, including a top panel, a first side panel, a second side panel, a bottom panel, the exiting end, and a closed end; the exiting end being formed at least partially by the end flaps; the end flaps including at least a first side end flap and a second side end flap; the first side end flap connected along the transverse fold line to the first side panel; the second side end flap connected along the transverse fold line to the second side panel; the first side end flap extending a first distance from the transverse fold line to the free end of the first side end flap; the second side end flap extending a second distance from the transverse fold line to the free end of the second side end flap; the first distance and the second distance together being greater than the width of the bottom panel; the blank including a tear line that extends through the top panel, through the first side panel, through the second side panel, the first distance through the first side end flap, and the second distance through the second side end flap.

18. The blank of claim 17 wherein the plurality of containers includes a third container in the first row adjacent the first container, and wherein the tear line in the top panel is located between the first and third containers.

19. The blank of claim 17 wherein the second container has a diameter, and wherein the tear line in the first side end flap and in the second side end flap is at a height from the bottom panel that is less than the diameter.

20. The blank of claim 17 wherein a dispenser is formed by the tear line; the dispenser being configured to catch the first container when the dispenser is opened.

21. The blank of claim 17 wherein neither the first side panel nor the second side panel includes cut lines for receiving adhesive.

* * * * *

US008123072C1

(12) INTER PARTES REEXAMINATION CERTIFICATE (715th)

United States Patent
Spivey

(10) Number: US 8,123,072 C1
(45) **Certificate Issued: *Oct. 24, 2013**

(54) CARTON WITH AN IMPROVED DISPENSING FEATURE

(75) Inventor: Raymond Rudolph Spivey, Mableton, GA (US)

(73) Assignee: Bank of America, N.A., San Francisco, CA (US)

Reexamination Request:
No. 95/001,909, Apr. 4, 2012

Reexamination Certificate for:

| | |
|---|---|
| Patent No.: | **8,123,072** |
| Issued: | **Feb. 28, 2012** |
| Appl. No.: | **13/094,962** |
| Filed: | **Apr. 27, 2011** |

( * ) Notice: This patent is subject to a terminal disclaimer.

Related U.S. Application Data

(63) Continuation of application No. 12/406,537, filed on Mar. 18, 2009, now Pat. No. 7,946,451, which is a continuation of application No. 11/470,428, filed on Sep. 6, 2006, now Pat. No. 7,523,842, which is a continuation of application No. 10/959,870, filed on Oct. 6, 2004, now Pat. No. 7,175,047, which is a continuation of application No. 10/777,614, filed on Feb. 12, 2004, now Pat. No. 7,100,798, which is a continuation of application No. 10/425,846, filed on Apr. 29, 2003, now Pat. No. 6,715,639, which is a continuation of application No. 09/757,714, filed on Jan. 9, 2001, now Pat. No. 6,578,736.

(51) Int. Cl.
*A47F 1/04* (2006.01)

(52) U.S. Cl.
USPC ..... 221/305

(58) Field of Classification Search
USPC ..... 221/305
See application file for complete search history.

(56) References Cited

To view the complete listing of prior art documents cited during the proceeding for Reexamination Control Number 95/001,909, please refer to the USPTO's public Patent Application Information Retrieval (PAIR) system under the Display References tab.

*Primary Examiner* — Matthew C. Graham

(57) ABSTRACT

A carton with an improved dispenser at one of the carton which preserves the integrity of the carton when the carton is opened by permitting a bottom end flap attached to the bottom panel to remain in place and also a portion of each side end flap that is adjacent to the bottom end flap. This dispenser may also provide a safety net for the first container that is automatically dispensed when the carton is opened.

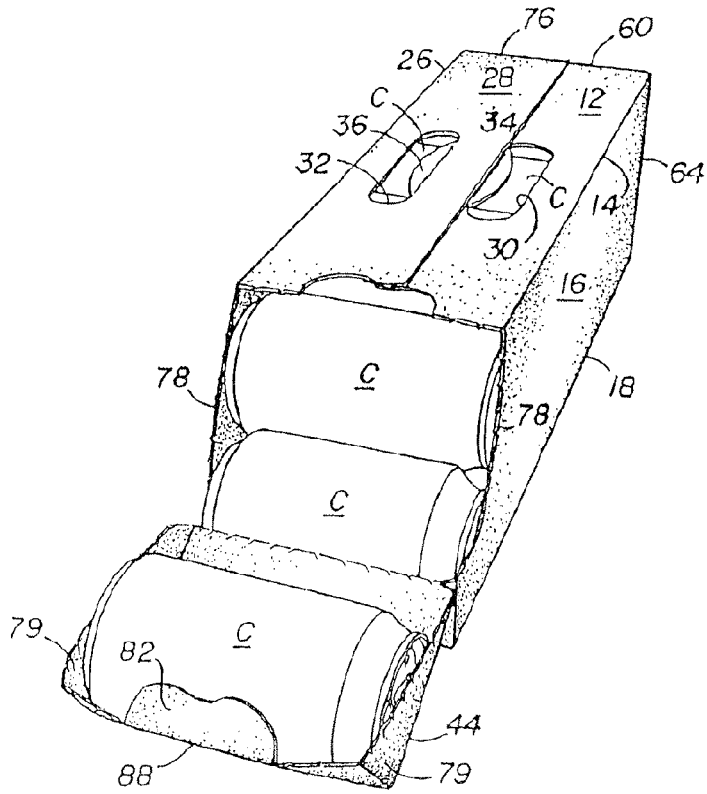

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-21 are cancelled.

* * * * *